US005753055A

United States Patent [19]

Liu

[11] Patent Number: 5,753,055

[45] Date of Patent: May 19, 1998

[54] PROCESS FOR AUSTEMPERING DUCTILE IRON

[75] Inventor: Xiaojun Liu, Coshocton, Ohio

[73] Assignee: Standard Car Truck Company, Park Ridge, Ill.

[21] Appl. No.: 743,649

[22] Filed: Nov. 5, 1996

[51] Int. Cl.[6] ..... C21D 5/00

[52] U.S. Cl. ..... 148/545; 148/612

[58] Field of Search ..... 148/545, 612, 148/321

[56] References Cited

U.S. PATENT DOCUMENTS 4,891,076 1/1990 Kovacs ..... 148/545

5,522,949 6/1996 Widmer et al. ..... 148/545

FOREIGN PATENT DOCUMENTS 0144907 6/1985 European Pat. Off. ..... 148/545

*Primary Examiner*—Deborah Yee

*Attorney, Agent, or Firm*—Dorn, McEachran, Jambor & Keating

[57] ABSTRACT

A process for austempering ductile iron includes austenitizing a ductile iron casting of low alloy content followed by quenching the workpiece for a controlled period of time in a quench medium such as water, an aqueous polymer solution or a medium speed quench oil. The workpiece is then austempered in an air tempering furnace, resulting in a ausferrite microstructure essentially free of pearlite and martensite, and with mechanical properties meeting ASTM designation A897-90 "Standard Specification for Austempered Ductile Iron Castings." The process eliminates the need for a molten salt bath for quenching and tempering.

6 Claims, 2 Drawing Sheets

PROCESS FOR AUSTEMPERING DUCTILE IRON

THE FIELD OF THE INVENTION

The present invention relates to a ductile iron austempering process which eliminates any use of molten salts in the austenitizing, quenching and tempering stages of the process. It is common in the quenching of an austempered ductile iron to use a molten salt bath as the quenching medium. However, the use of molten salt for the described purpose creates a number of undesirable side effects. Specifically, there is high energy consumption because of the elevated temperature of the salt bath, there is increased capital equipment costs for the bath and for the equipment that operates it. There are very substantial environmental concerns over the safe removal and elimination of the salt and there is also a certain degree of hazard to workmen associated with using molten salt as a quenching medium.

The present invention, contrary to conventional thinking in the austempering of ductile iron, uses a quenching medium which has a substantially lower temperature than current processes. It is necessary in preparing an austempered ductile iron, particularly one for use as a friction wedge in a railroad car truck, that the iron have a matrix which is essentially ausferrite and that there be no martensite or pearlite. In the past, when lower quench temperatures were used, it was common for martensite to be present in the final product and it was for that reason that elevated quenching temperatures, particularly using molten salt, became the quenching medium of choice for austempered ductile iron. The present invention utilizes a quench medium such as water, an aqueous polymer solution or an oil at a temperature as low as ambient and for a very short duration of time to provide an austempered ductile iron which is essentially free of martensite and pearlite and is substantially ausferritic in its matrix.

SUMMARY OF THE INVENTION

The present invention relates to a process for austempering ductile iron which involves austenitizing a ductile iron casting of low alloy content followed by a quench for a controlled period of time in a quenching medium such as water, an aqueous polymer solution or oil.

Another purpose of the invention is an austempering process which eliminates the use of molten salt as a quenching medium and a tempering medium.

Another purpose is an austempering process using a quench medium substantially lower in temperature than prior art quenching solutions and which provides an essentially ausferrite matrix in the ductile iron.

Another purpose is a process for austempering ductile iron which includes the steps of austenitizing the workpiece at a temperature of approximately 1600°–1700° F. for approximately 60 to 180 minutes, followed by quenching the workpiece in a solution chosen from water, an aqueous polymer, or oil at a temperature as low as ambient, and for a time period within the range of not substantially less than 15 seconds to not substantially more than 120 seconds, followed by a tempering at a temperature between 450° to 840° F., based on the microstructure desired and the grades of austempered ductile iron intended to be produced, for a time period until the desired ausferrite transformation is achieved.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

Figure 1:
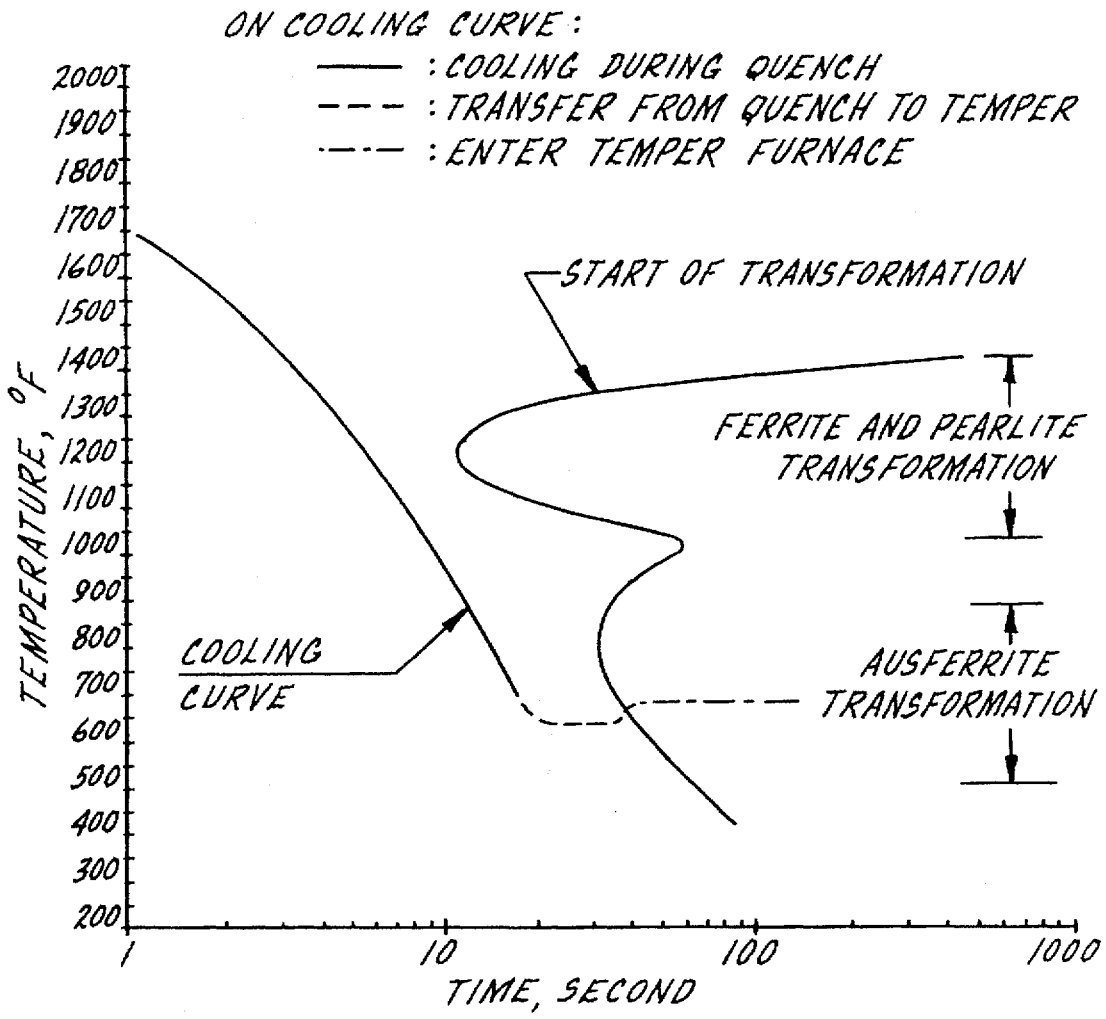
FIG. 1 is a time temperature transformation diagram upon which the cooling curve from the quenching step has been superimposed.

U. S. Pat. No. 4,166,756, owned by Standard Car Truck Company of Park Ridge, Ill., assignee of the present application, describes a railroad car friction casting metallurgy and in particular a process for the manufacture of friction castings for use in damping side frame/bolster movement in railroad car trucks. The iron described in the '756 patent has flake graphite with a matrix of acicular bainite plus some martensite. The present invention is directed to providing an improved austempered ductile iron and a process for the manufacture of the same, which ductile iron essentially eliminates martensite and has an ausferrite matrix with nodules of graphite.

It is conventional practice in the manufacture of ductile iron for the use described to use a molten salt bath as the quenching medium. The elimination of molten salt in the austempering process leads to a substantial reduction in capital equipment cost and energy consumption, and the elimination of solid and liquid waste disposal problems. The resulting ausferritic microstructure is free of pearlite and martensite and has mechanical properties meeting ASTM designation A897-90 "Standard Specification for Austempered Ductile Iron Castings."

The process of the present invention utilizes a metallurgy having essentially the following characteristics:

| Element | Percent by Weight |
|---|---|
| Carbon | 3.50–4.20 |
| Silicon | 2.00–3.00 |
| Manganese | <0.30 |
| Phosphorous | <0.35 |
| Sulfur | <0.012 |
| Magnesium | 0.035–0.055 |
| Nickel | Trace |
| Chromium | Trace |
| Copper | Trace–0.50 |
| Molybdenum | Trace |
| Iron | Balance |

The first step in the austempering process is to austenitize the iron at a temperature of 1600°–1700° F. for a time period of approximately 60 to 180 minutes. After austenitizing, the ductile iron workpiece is quickly placed in a quench medium chosen from water, an aqueous polymer solution or oil at a temperature as low as ambient. If water is used, the preferred temperature is 150°–180° F. A 15% polyaklylene glycol solution preferably is at 75°–110° F. and medium speed mineral oil preferably is at 75°–180° F. Time in the quenching solution is within the range of not substantially less than 15 seconds to not substantially more than 120 seconds. After quenching, the workpiece is quickly transferred to a tempering furnace at a temperature between 450° to 840° F. The workpiece remains in the furnace until the desired phase transformation is achieved. Following the tempering process, the workpiece is air cooled and then subject to a water rinse.

EXAMPLE 1

TABLE I

| Element | Percent by Weight |
|---|---|
| Carbon | 3.78 |
| Silicon | 2.66 |
| Manganese | 0.21 |
| Phosphorous | 0.029 |
| Sulfur | 0.012 |
| Nickel | Trace |
| Chromium | Trace |
| Copper | 0.09 |
| Molybdenum | Trace |
| Magnesium | 0.036 |
| Iron | Balance |

A ductile iron workpiece having the chemistry set forth in Table I was austenitized at 1650° F. for 180 minutes. The workpiece was quenched in 160° F. water for 20 seconds, then transferred to the temper furnace at 620° F. and held at that temperature for 120 minutes. After tempering, the workpiece was air cooled for three minutes, followed by a water rinse. Test results on the workpiece are as illustrated in Table II below.

TABLE II

| Tensile and wear test results | | | | |
|---|---|---|---|---|
| Brinell hardness | Ultimate strength (psi) | Yield strength (psi) | % elongation | Wear test result (gram/k · cycle) |
| 415 | 180,100 | 139,000 | 6.0 | 0.0027 |

EXAMPLE 2

TABLE III

| Element | Percent by weight |
|---|---|
| Carbon | 3.81 |
| Silicon | 2.68 |
| Manganese | 0.26 |
| Phosphorous | 0.033 |
| Sulfur | 0.011 |
| Nickel | Trace |
| Chromium | Trace |
| Copper | 0.49 |
| Molybdenum | Trace |
| Magnesium | 0.046 |
| Iron | Balance |

A ductile iron workpiece having the chemistry set forth in Table III was austenitized at 1650° F. for 180 minutes followed by immediate quenching in an ambient temperature polyalkylene glycol aqueous solution for 30 seconds. The workpiece was then transferred to the temper furnace at 620° F. and held at that temperature for 180 minutes. After tempering, the iron piece was air cooled for three minutes, followed by a water rinse. The test results on the iron piece treated in the above manner is set forth in Table IV.

TABLE IV

| Tensile and wear test results | | | | |
|---|---|---|---|---|
| Brinell hardness | Ultimate strength (psi) | Yield strength (psi) | % elongation | Wear test result (gram/k · cycle) |
| 388 | 192,000 | 147,000 | 11.0 | 0.0037 |

EXAMPLE 3

TABLE V

| Element | Percent by weight |
|---|---|
| Carbon | 3.63 |
| Silicon | 2.65 |
| Manganese | 0.19 |
| Phosphorous | 0.027 |
| Sulfur | 0.012 |
| Nickel | Trace |
| Chromium | Trace |
| Copper | 0.10 |
| Molybdenum | Trace |
| Magnesium | 0.043 |
| Iron | Balance |

A workpiece having the chemistry set forth in Table V was austenitized at 1650° F., for 180 minutes, followed by immediate quenching in an ambient temperature medium speed quench oil for 50 seconds, and then transferred to the temper furnace at 620° F. and held at that temperature for 180 minutes. After tempering, the iron piece was air cooled for three minutes, followed by a water rinse. The test results on the workpiece are set forth in Table VI.

TABLE VI

| Tensile and wear test results | | | | |
|---|---|---|---|---|
| Brinell hardness | Ultimate strength (psi) | Yield strength (psi) | % elongation | Wear test result (gram/k · cycle) |
| 352 | 176,000 | 135,000 | 8.0 | 0.0023 |

A workpiece having the chemistry set forth in Table V was austenitized at 1650° F., for 180 minutes, followed by immediate quenching in a 180° F. medium speed quench oil for 60 seconds, and then transferred to the temper furnace at 620° F., and held at that temperature for 180 minutes. After tempering, the workpiece was air cooled for three minutes, followed by a water rinse. Four unnotched Charpy impact tests were conducted at 77° F. using samples from this workpiece. The impact energy from the average of the highest three test values is 66 ft-lb.

Another workpiece having the chemistry set forth in Table V was austenitized at 1650° F. for 180 minutes, followed by immediate quenching in a 140° F. medium speed quench oil for 30 seconds, and then transferred to the temper furnace at 620° F., and held at that temperature for 180 minutes. After tempering, the workpiece was air cooled for three minutes, followed by a water rinse. Four unnotched Charpy impact tests were conducted at 77° F. using samples from this workpiece. The impact energy from the average of the highest three test values is 103 ft-lb.

The wear test simulates the wear process in a friction wedge/wear plate pair on the railroad freight car side frame/ bolster assembly. The test coupons of austempered ductile iron of the described process are forced to wear against coupons of a high carbon heat treated steel. With 5,000 break-in and 75,000 testing wear cycles, the wear rates shown in Tables II, IV and VI compare favorably with materials made by conventional heat treating processes.

FIG. 1 illustrates a time-temperature transformation diagram for the ductile iron having the chemistry disclosed herein, with the cooling curve in the quenching medium superimposed thereon. What is important is to avoid a transformation into pearlite, to assure an ausferritic transformation and to eliminate the possibility of a martensitic matrix in the heat treated ductile iron. By quenching in a medium at ambient to moderate temperature, the single phase austenite will not transform to a high temperature phase such as pearlite, as illustrated in FIG. 1. Further, the quick transfer of the workpiece to a recirculation furnace prevents the workpiece from transforming into a low temperature martensite phase. In this connection, the martensite starting temperature of the austenite phase is relatively low due to the relatively high carbon content of the workpiece chemistry.

As specifically illustrated in FIG. 1, the quench is interrupted at the point when the workpiece reaches the targeted temperature and while the workpiece is still in the state of single phase austenite. The workpiece will be quickly transferred to an air temper furnace, preferably of the recirculation type, which is set at the desired austempering temperature. The workpiece will be held in the temper furnace until the desired phase transformation is achieved.

Figure 2:
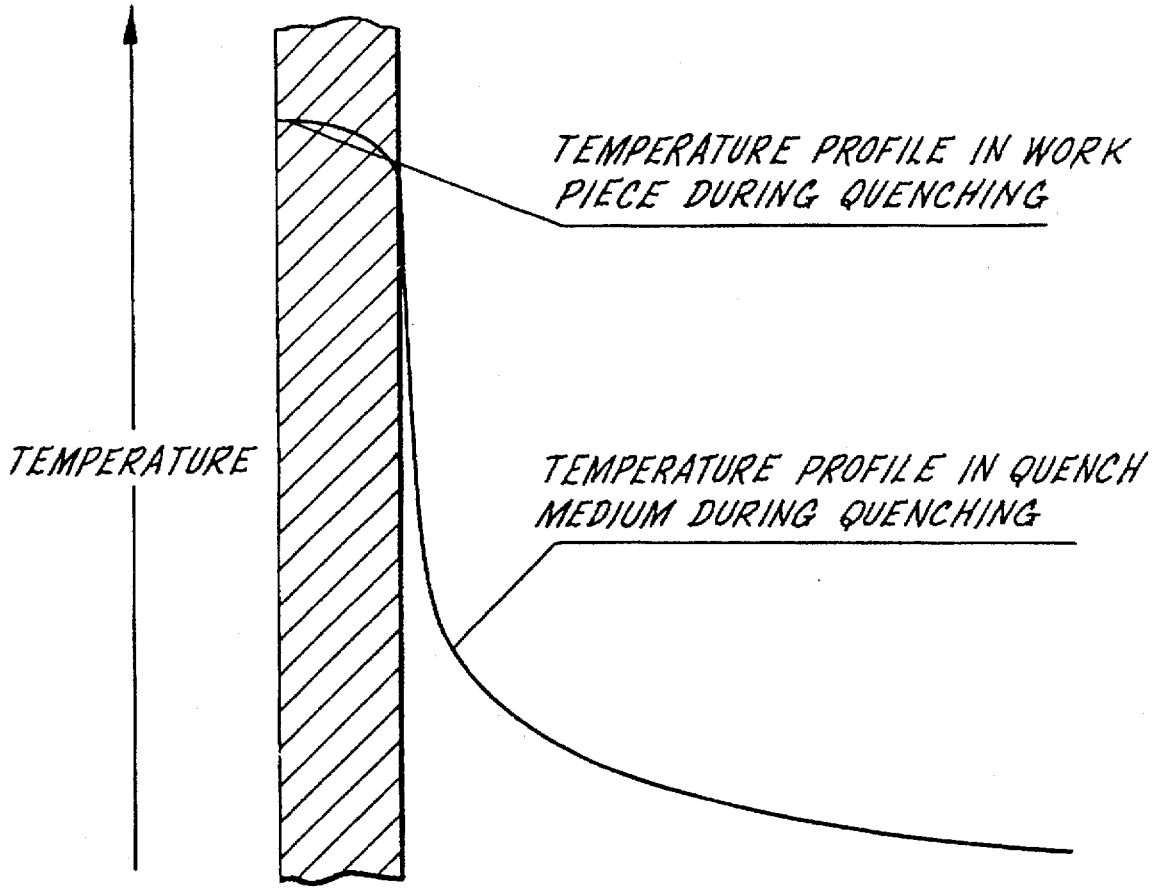
FIG. 2 is a quench period temperature profile diagram showing the temperature gradient across the workpiece and in the adjacent quenching medium.

As is illustrated in FIG. 2, under a normal quench medium agitation condition, a majority of the temperature difference occurs within the thin quench medium layer next to the surface of the workpiece, which allows quench to be interrupted with the workpiece at a temperature substantially higher than the temperature of the quench medium. Also, compared to the temperature change in the quench medium away from the surface of the workpiece, the temperature profile across the cross section of the workpiece is much flatter, which will allow temperatures in the center and near the surface of the workpiece to be in a very close range and later reach the austempering temperature quickly after the workpiece is transferred to the temper furnace.

Though by properly adjusting the heat treating conditions, the present invention can be used to produce all grades of austempered ductile iron as they are defined in the ASTM designation A897-90, it is most applicable for heat treating higher grades of austempered ductile iron, such as grades 150/100/7, 175/125/4, and 200/155/1, due to the low temperature quench medium that is used in the process. In particular, the present invention can be applied to produce railroad car friction wedge castings that require a desired combination of strength, toughness, wear, and frictional properties.

Whereas the preferred form of the invention has been shown and described herein, it should be realized that there may be many modifications, substitutions and alterations thereto.

The embodiments of the invention in which an exclusive property or privilege is claimed are defined as follows:

1. A process for austempering a ductile iron workpiece of low alloy content resulting in an ausferrite microstructure essentially free of pearlite and martensite which includes the steps of:

(a) austenitizing the workpiece at a controlled temperature and for a controlled time period;

(b) quenching the workpiece in a solution chosen from water, an aqueous polymer solution, or oil for a controlled period of time and at a temperature no lower than ambient and no greater than approximately 180° F. degrees; and (c) tempering the workpiece for a controlled period of time and at a controlled temperature.

2. A process for austempering a ductile iron workpiece of low alloy content resulting in an ausferrite microstructure essentially free of pearlite and martensite which includes the steps of:

(a) austenitizing the workpiece at a temperature of 1600°–1700° F. for approximately 60 to 180 minutes;

(b) quenching the workpiece in a solution chosen from water, an aqueous polymer solution, or time period within the range of not substantially less than 15 seconds to not substantially more than 120 seconds; and (c) tempering the workpiece at a temperature between 450° to 840° F., based on the microstructure desired and the grades of austempered ductile iron intended to produce.

3. The process of claim 2 wherein the quenching medium is water at a temperature of approximately 150°–180° F. and the quenching period is approximately 15 to 40 seconds.

4. The process of claim 2 wherein the quenching solution is polyalkylene glycol at a temperature of approximately 75°–110° F. and the quenching period is approximately 15 to 60 seconds.

5. The process of claim 2 wherein the quenching solution is medium speed mineral oil at a temperature as low as ambient and the quenching period is approximately 20 to 120 seconds.

6. The process of claim 2 wherein the ductile iron workpiece has the following chemistry:

| Element | Percent by Weight |
|---|---|
| Carbon | 3.50–4.20 |
| Silicon | 2.00–3.00 |
| Manganese | <0.30 |
| Phosphorous | <0.35 |
| Sulfur | <0.012 |
| Magnesium | 0.035–0.055 |
| Nickel | Trace |
| Chromium | Trace |
| Copper | Trace–0.50 |
| Molybdenum | Trace |
| Iron | Balance |

* * * * *